US009556698B2

(12) United States Patent
Nguyen

(10) Patent No.: US 9,556,698 B2
(45) Date of Patent: Jan. 31, 2017

(54) LANDING SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 14/587,874

(22) Filed: Dec. 31, 2014

(65) Prior Publication Data

US 2016/0186520 A1 Jun. 30, 2016

(51) Int. Cl.
*E21B 33/04* (2006.01)
*E21B 23/01* (2006.01)
*E21B 33/03* (2006.01)

(52) U.S. Cl.
CPC ..... *E21B 33/04* (2013.01); *E21B 23/01* (2013.01); *E21B 33/03* (2013.01)

(58) Field of Classification Search
CPC ..... E21B 33/04; E21B 43/10; E21B 23/00; E21B 33/03; E21B 33/06; E21B 34/02
USPC ..... 166/368, 75.11, 83.1, 382, 383, 77.51
See application file for complete search history.

(56) References Cited

U.S. PATENT DOCUMENTS 2,148,360 A * 2/1939 Lemley ..... E21B 33/04 166/88.1
2,475,429 A * 7/1949 Humason ..... E21B 33/04 175/210
3,193,308 A * 7/1965 Todd ..... E21B 33/04 285/123.3
3,800,871 A * 4/1974 Watson ..... E21B 23/01 166/212
3,901,546 A * 8/1975 Piazza ..... E21B 33/04 294/86.15
4,057,267 A * 11/1977 Jansen, Jr. ..... F16L 37/002 285/18
4,770,250 A * 9/1988 Bridges ..... F16L 37/002 166/382
7,441,594 B2 * 10/2008 Vanderford ..... E21B 33/04 166/368
8,230,914 B2 * 7/2012 Hallundbaek ..... E21B 23/01 166/206

(Continued)

FOREIGN PATENT DOCUMENTS

DE 29920132 U1 12/2000
EP 1860275 A1 11/2007
WO 2009/009085 A1 1/2009

OTHER PUBLICATIONS

PCT International Search Report & Written Opinion; Application No. PCT/US2015/065110; Dated Mar. 18, 2016; 11 Pages.

*Primary Examiner* — James G Sayre
(74) *Attorney, Agent, or Firm* — Fletcher Yoder P.C.

(57) ABSTRACT

A system includes a landing system with a landing member configured to move between an extended position and a retracted position inside an axial bore of a mineral extraction system component. The landing system further includes a shaft configured to drive the landing member in a first radial direction. The landing system further includes an actuation system configured to move the shaft in the first radial direction within the axial bore to move the landing member into the extended position. The landing system further includes a spring configured to drive the shaft in a second radial direction to retract the landing member.

20 Claims, 5 Drawing Sheets

(56) References Cited

U.S. PATENT DOCUMENTS

| | | | | |
|---|---|---|---|---|
| 8,826,988 | B2 * | 9/2014 | Gray | E21B 23/04 166/338 |
| 2005/0067168 | A1 * | 3/2005 | Baird | E21B 19/10 166/380 |
| 2012/0097399 | A1 | 4/2012 | Kobata et al. | |
| 2013/0075103 | A1 | 3/2013 | Herbel | |

* cited by examiner

LANDING SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of a well. Such hangers may be disposed within a wellhead that supports both the hanger and the string. For example, a tubing hanger may be lowered into a wellhead and supported therein. To facilitate the running or lowering process, the tubing hanger may couple to a tubing hanger running tool (THRT). Once the tubing hanger has been lowered into a landed position within the wellhead by the THRT, the tubing hanger may then be locked into position. The THRT may then be disconnected from the tubing hanger and extracted from the wellhead. Unfortunately, wellheads components (e.g., spools) with preformed ledges or landings reduce the size of the bore, which requires either smaller drilling equipment or larger more expensive wellheads with larger bores.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a landing system that enables use of wellhead components without a preformed landing. Accordingly, the component may be smaller while still providing a bore size that accommodates standard drilling equipment. The landing system includes a landing member, a shaft, and an actuation system. In operation, the actuation system is capable of driving the shaft in a first direction and into contact with the landing member. As the shaft contacts the landing member, the shaft drives the landing member into a bore of a mineral extraction system component (e.g., spool). The actuation system may be hydraulic or mechanical. In order to retract the landing member, the landing system includes a spring that drives the shaft in a second direction, enabling the landing member to relax and retract from the bore of the mineral extraction component.

Figure 1:
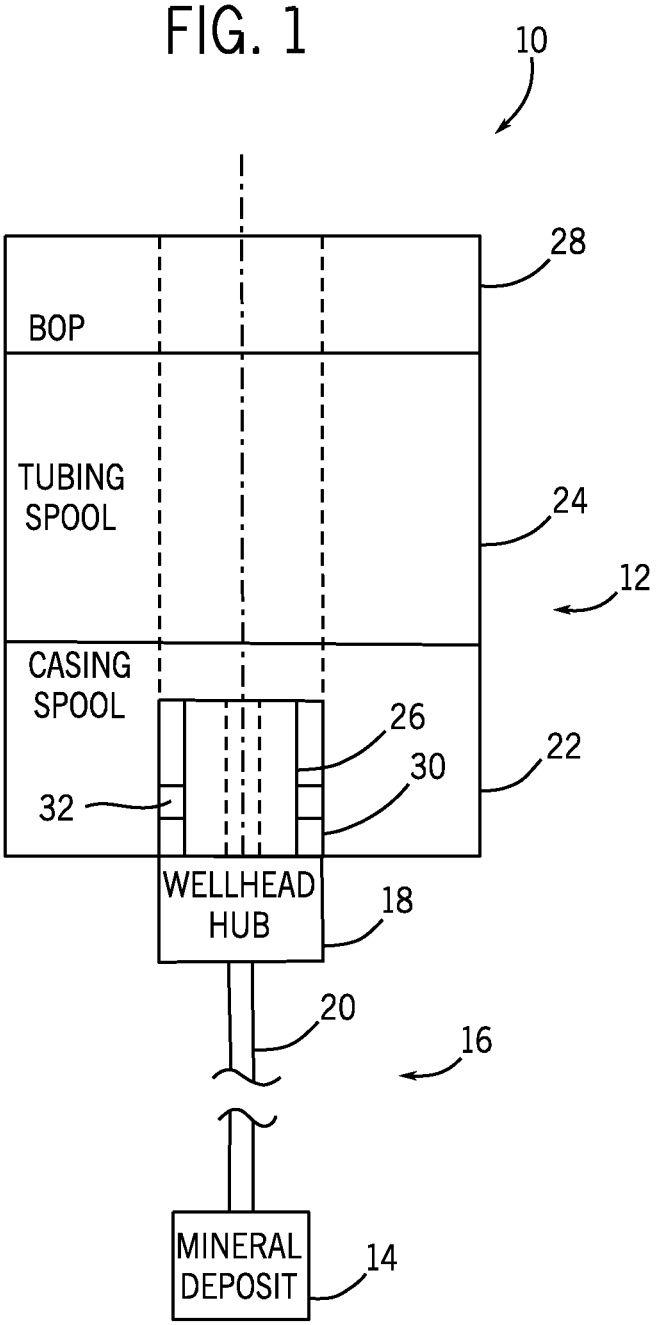
FIG. 1 is a block diagram of an embodiment of a mineral extraction system with a landing system.

FIG. 1 is a block diagram that illustrates a mineral extraction system 10 (e.g., hydrocarbon extraction system) that can extract various minerals and natural resources, including hydrocarbons (e.g., oil and/or natural gas) from the earth. The mineral extraction system 10 may be land-based (e.g., a surface system) or subsea (e.g., a subsea system). The system 10 includes a wellhead 12 coupled to a mineral deposit 14 via a well 16, wherein the well 16 includes a wellhead hub 18 and a well-bore 20. The wellhead hub 18 includes a large diameter hub at the end of the well-bore 20 that enables the wellhead 12 to couple to the well 16. The wellhead 12 includes multiple components that control and regulate activities and conditions associated with the well 16. For example, the wellhead 12 includes a spool 22 (e.g., tubular), a tubing spool 24 (e.g., tubular), a hanger 26 (e.g., a tubing hanger or a casing hanger), a blowout preventer (BOP) 28 and a "Christmas" tree (not shown).

In operation, the wellhead 12 enables completion and workover procedures, such as tool insertion (e.g., the hanger 26) into the well 16 and the injection of various chemicals into the well 16. Further, minerals extracted from the well 16 (e.g., oil and natural gas) may be regulated and routed via the wellhead 12. For example, the blowout preventer (BOP) 28 or "Christmas" tree may include a variety of valves, fittings, and controls to prevent oil, gas, or other fluid from exiting the well 16 in the event of an unintentional release of pressure or an overpressure condition.

As illustrated, the spool 22 defines a bore 30 that enables fluid communication between the wellhead 12 and the well 16. Thus, the casing spool bore 30 may provide access to the well bore 20 for various completion and workover procedures, such as emplacing the hanger 26 within the spool 22. To emplace the hanger 26, the hydrocarbon extraction system 10 includes a landing system 32. The landing system 32 provides a temporary or permanent landing that can support the hanger 26 or other pieces of drilling equipment (e.g., hanger 26). For example after drilling, the landing system 32 may radially extend into the bore 30 to support or couple to the hanger 26. After use, the landing system 32 may retract providing complete use of the bore 30. The ability to extend into and retract from the bore 30 maximizes use of the casing spool bore 30 for drilling operations, while still providing support for the tubing hanger 26 in the spool 22 after drilling operations.

Figure 2:
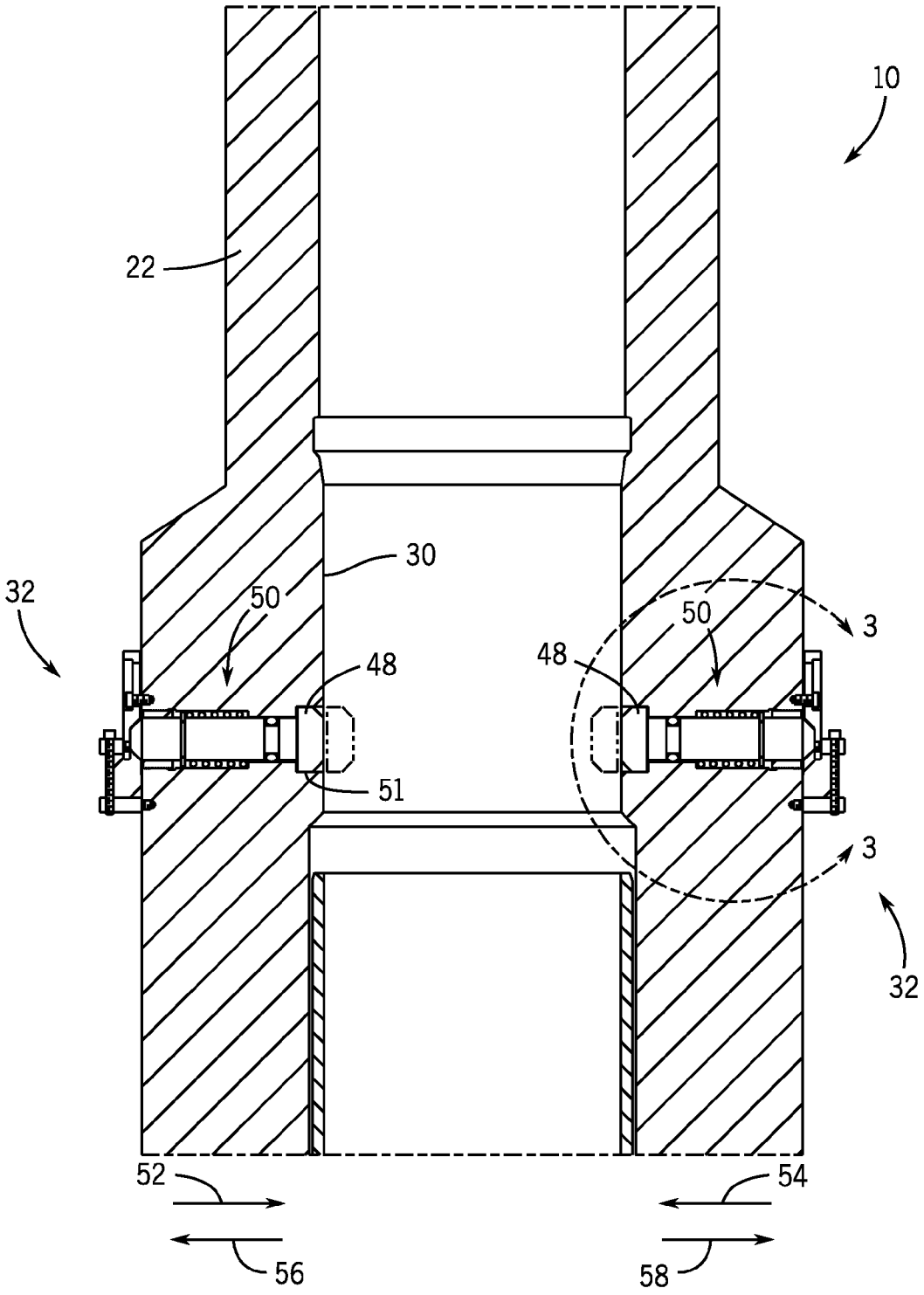
FIG. 2 is a cross-sectional view of a landing system in a retracted position.

FIG. 2 is a cross-sectional view of the landing system 32 in a retracted position. The landing system 32 may include a load ring 48 (e.g., c-ring) and one or more radial actuators 50 (e.g., 1, 2, 3, 4, 5, or more) circumferentially spaced (e.g., uniformly, non-uniformly) about the spool 22. The radial actuators 50 may include, for example, radial load pins, pistons, or shafts. For simplicity, the radial actuators 50 will be referred to as load pins 50 in the following discussion. In operation, the landing system 32 drives the load ring 48 radially inward to provide a temporary or permanent landing that supports various drilling equipment (e.g., hanger 26). The landing system 32 may also enable the load ring 48 to retract and reenter a groove 51 (e.g., annular groove), thus maximizing the size of the bore 30 for use by drilling equipment. As will be explained in detail below, the landing system 32 drives the load pins 50 in directions 52 and 54 as well as retracts the load pins 50 in directions 56 and 58 in order to extend and retract the load ring 48.

Figure 3:
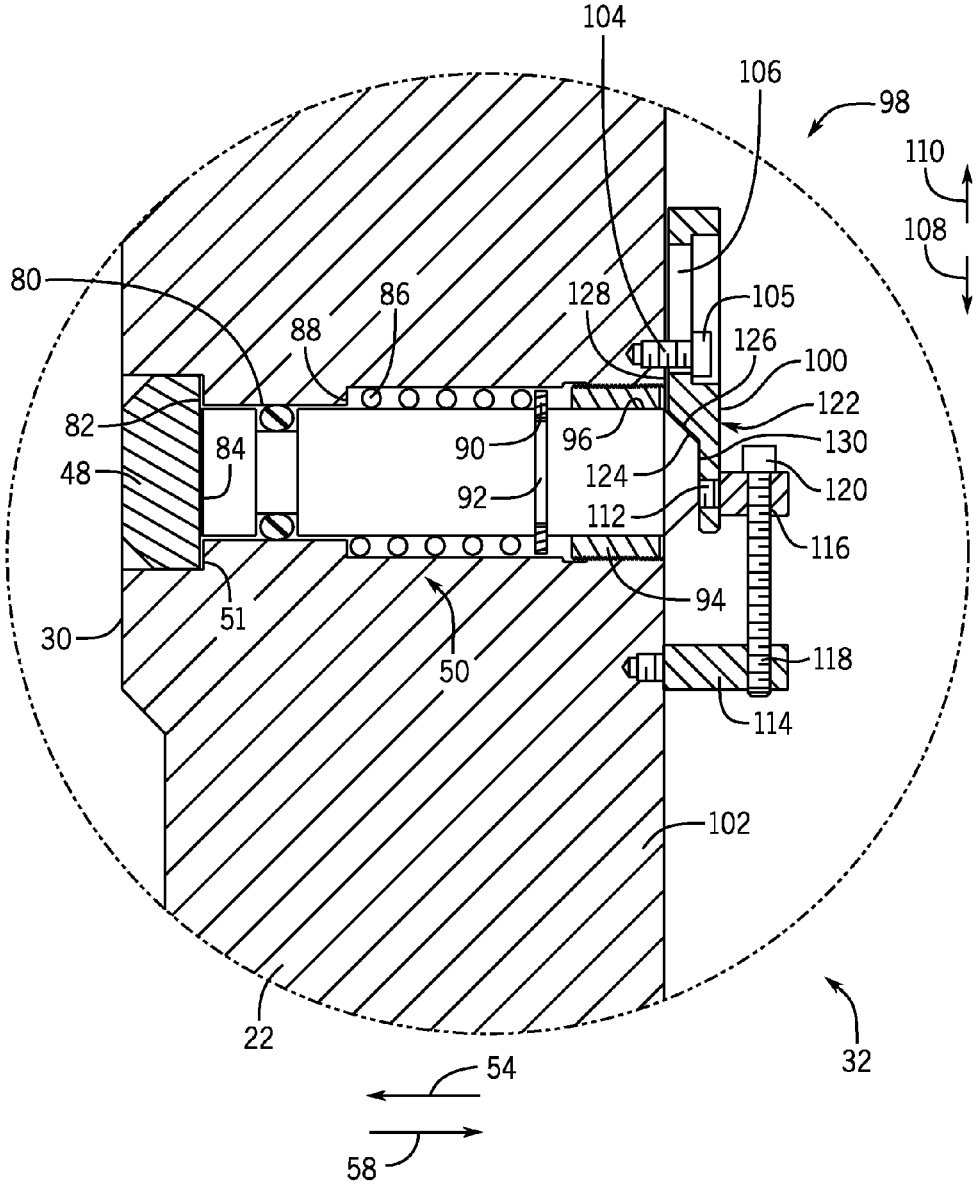
FIG. 3 is a partial cross-sectional view of a landing system in a retracted position within line 3-3 of FIG. 2.

FIG. 3 is a sectional view of a landing system 32 in a retracted position within line 3-3 of FIG. 2. As explained above, the landing system 32 includes the load pin 50. The load pin 50 rests within a bore 80 (e.g., radial bore) in the spool 22 and extends through the bore 80 where the load pin 50 contacts an outer circumferential surface 82 of the load ring 48 with a contact surface 84. Surrounding the load pin 50 is a spring 86 (e.g., helical spring). The landing system 32 retains the spring 86 within the bore 80 between a counterbore 88 in the spool 22 and an inner retaining ring 90. In this position, the spring 86 provides a biasing force against the inner retaining ring 90 that resists movement of the load pin 50 in radial direction 54 and biases the load pin 50 in a retracted position. In some embodiments, the inner retaining ring 90 is a removable ring that couples to a groove 92 on the load pin 50. However, in certain embodiments, the inner retaining ring 90 may be integrally formed with the load pin 50 (e.g., one-piece). To block the spring 86 from driving the load pin 50 out of the bore 80 in radial direction 58, the landing system 32 may include an outer retaining ring 94 that threadingly couples to the spool 22. The outer retaining ring 94 includes an aperture 96 that enables the load pin 50 to move within the outer retaining ring 94, but blocks complete retraction of the load pin 50 out of the bore 80 by contacting the inner retaining ring 90.

In order to drive the load pin 50 in radial direction 58, the landing system 32 includes an actuation system 98 (e.g., mechanical and/or hydraulic activation system) that drives the load pin 50 in radial direction 54. The mechanical actuation system 98 (e.g., threaded actuation system, cam-action activation system) includes a structure 100 that couples to an outer surface 102 of the spool 22 with a bolt 104. The structure 100 may include, for example, a plate or a shaft. For simplicity, the structure 100 will be referred to as a plate 100 in the following discussion of FIGS.3 and 4. The bolt 104 rests within an axial slot or aperture 106 of the plate 100 while the bolt head 105 blocks separation of the plate 100 from the casing 22. Accordingly, the bolt 104 enables the plate 100 to move axially in directions 108 and 110 while still coupling the plate 100 to the spool 22. Threadingly coupled to the plate 100 and to the outer surface 102 of the spool 22 are respective eyebolts 112 and 114 (e.g., mechanical device or connector). The eyebolts 112 and 114 include respective apertures 116 and 118 that enable a bolt 120 to axially drive movement of the plate 100. For example, as the bolt 120 threads into the eye bolt 114, the bolt 120 drives the plate 100 in axial direction 108. To facilitate movement of the load pin 50 in radial direction 54, the load pin 50 and plate 100 form an angled interface 122 (e.g., tapered interface) with an angled surface 124 (e.g., linear or curvilinear angled surface) on the load pin 50 and an angled surface 126 (e.g., linear or curvilinear angled surface) on the plate 100. As the two angled surfaces 124 and 126 contact one another, the plate 100 gradually drives the load pin 50 in radial direction 54 (e.g.,cam-action), compressing the spring 86. The plate 100 continues to drive the load pin 50 until the inner surface 128 contacts the end surface 130 of the load pin 50. In order to retract the load pin 50, the bolt 120 unthreads from the eyebolt 114. As the bolt 120 unthreads, the bolt 120 drives the plate 100 in axial direction 110, enabling the spring 86 to drive the load pin 50 in radial direction 58.

Figure 4:
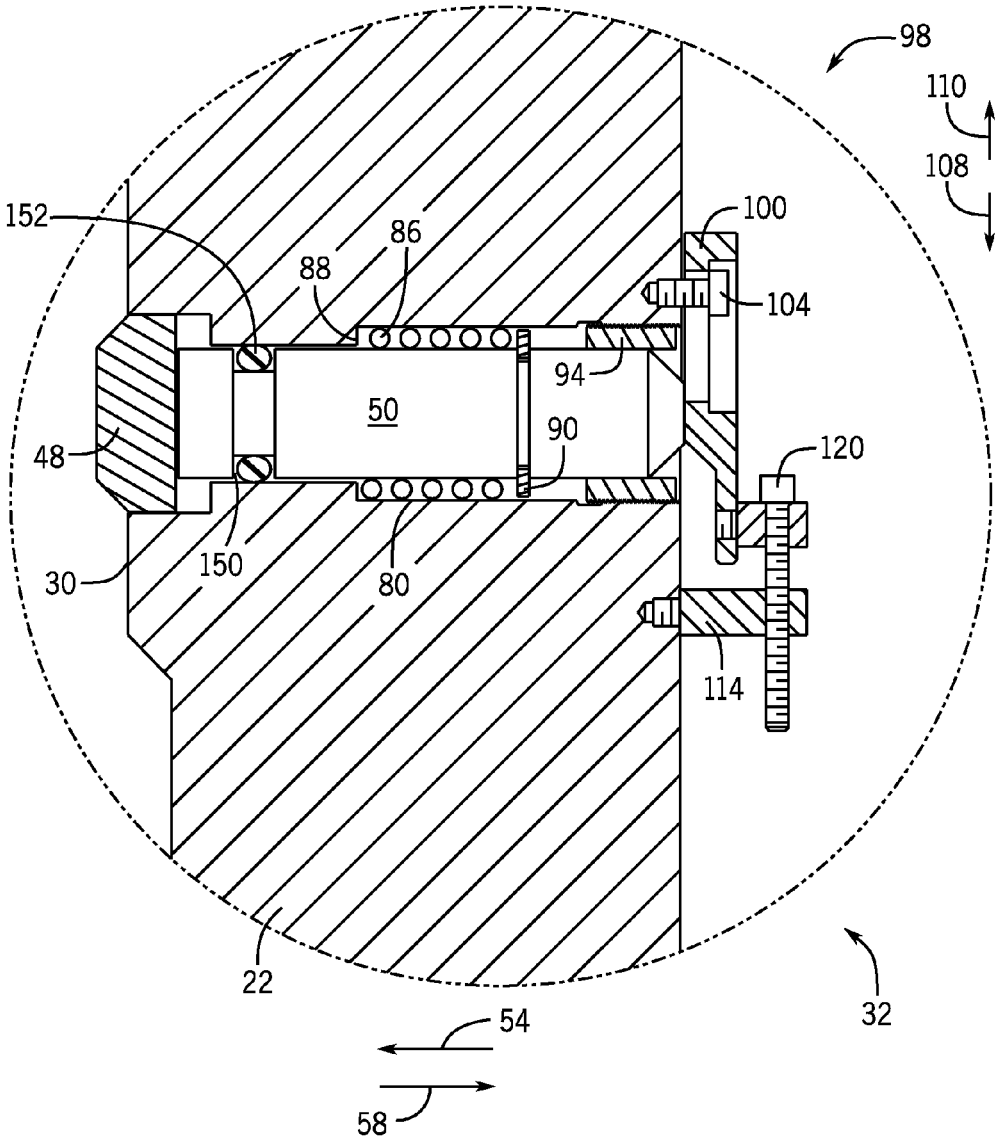
FIG. 4 is a partial cross-sectional view of a landing system in an extended position within line 3-3 of FIG. 2.

FIG. 4 is a sectional view of a landing system 32 in an extended position within line 3-3 of FIG. 2. As illustrated, the bolt 120 has moved in axial direction 108 driving the load pin 50 in radial direction 54 with the plate 100. The force of the plate 100 on the load pin 50 enables the load pin 50 to compress the spring 86 between the counterbore 88 and the inner retaining ring 90 driving the load ring 48 into the bore 30. In this position, the load ring 48 is in an extended position capable of supporting/suspending equipment within the spool 22. For example, the tubing hanger 26 may rest on the load ring 48. In some embodiments, the load pin 50 may drive the load ring 48 into a groove on the tubing hanger 26 or another piece of equipment, thus securing the equipment within the spool 22. As illustrated, the landing system 32 may also form a seal with the bore 80. For example, the load pin 50 may include one or more circumferential grooves 150 that receive one or more seals 152 (e.g., gaskets). In operation, the seal(s) 152 form a barrier with the bore 80 that blocks fluid flow into and out of the bore 30.

Figure 5:
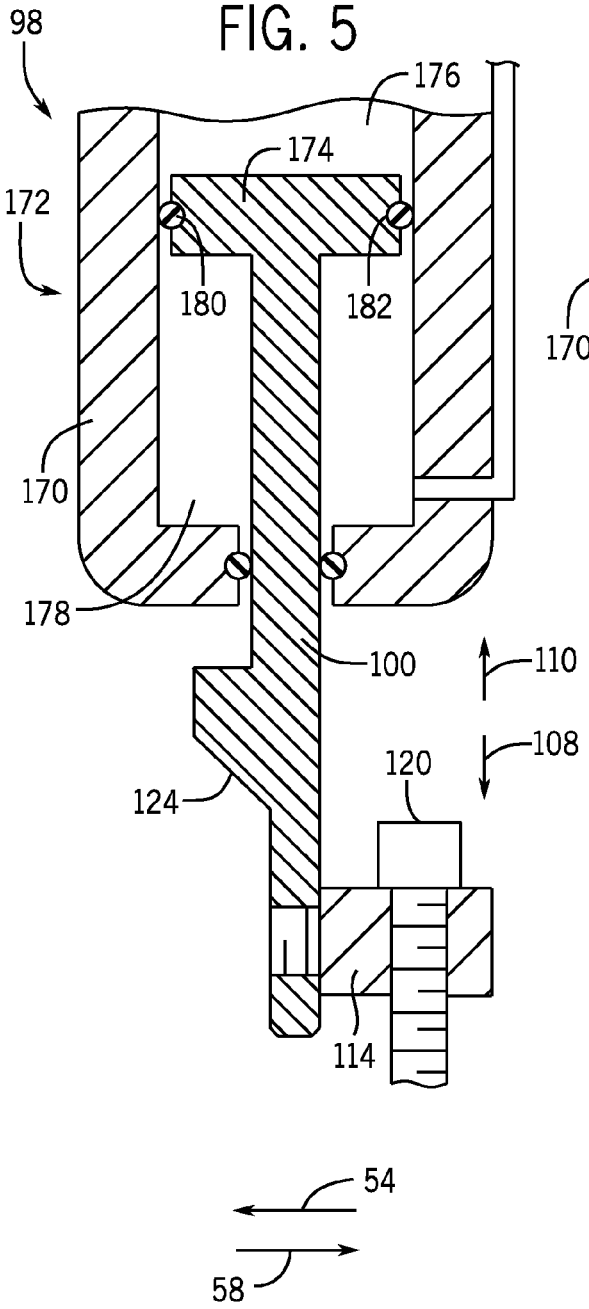
FIG. 5 is a cross-sectional view of a hydraulic system in a first position.

FIG. 5 is a cross-sectional view of an actuation system 98 in a first position. As illustrated, the actuation system 98 may use a fluid (e.g., hydraulic fluid) to drive the structure 100 between first and second axial positions. The structure 100 may include, for example, a plate or a shaft. For simplicity, the structure 100 will be referred to as a plate 100 in the following discussion of FIGS. 5 and 6. The actuation system 98 may include a hydraulic housing 170 with a hydraulic cavity 172 (e.g., cylinder) that receives an end portion 174 (e.g., annular piston) of the plate 100 of FIGS. 2-4. The end potion 174 (e.g., annular piston) divides the hydraulic cavity 172 into a first chamber 176 (e.g., cylinder portion) and a second chamber 178 (e.g., cylinder portion). For example, the end portion 174 may include one or more grooves 180 (e.g., 1, 2, 3, 4, 5, or more annular grooves) that receive one or more gaskets 182 (e.g., 1, 2, 3, 4, 5 or more gaskets or seals) that block fluid flow between the first chamber 176 and the second chamber 178. In operation, hydraulic fluid is pumped into the chambers 176 and 178 to drive the plate 100 (e.g., piston 174) in axial directions 110 or 108. For example, when fluid is pumped into the chamber 176, the fluid pressure moves the plate 100 (e.g., piston 174) in axial direction 108 enabling the plate 100 to drive the load pin 50 in radial direction 54.

Figure 6:
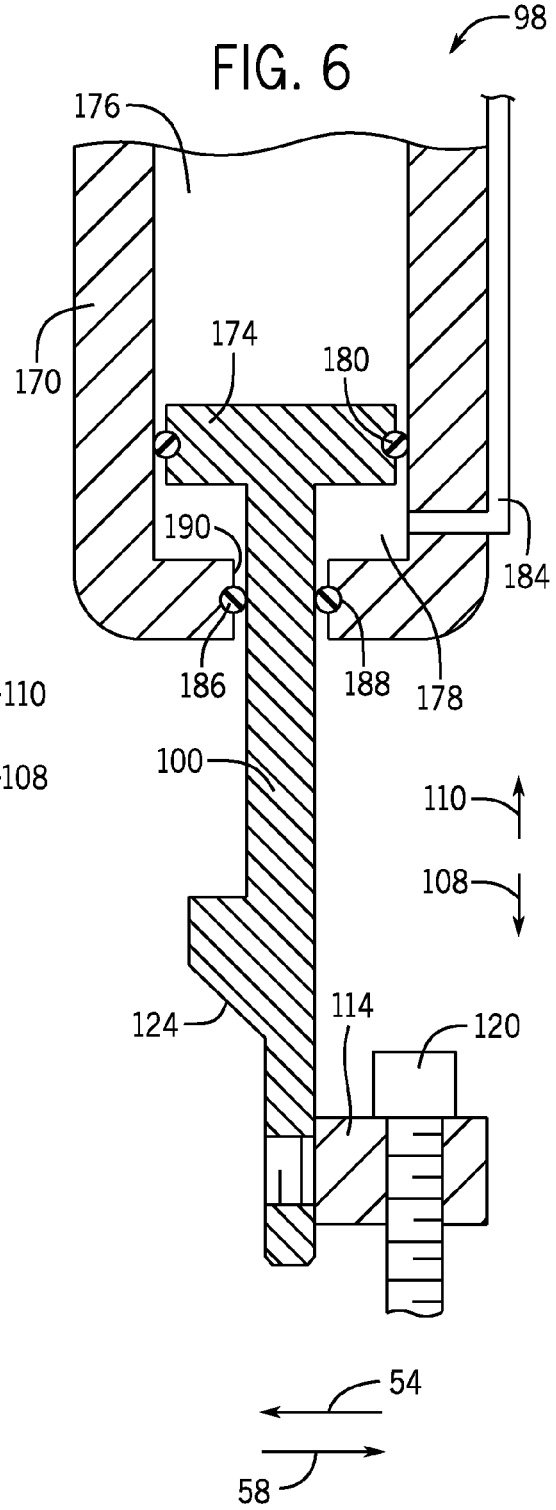
FIG. 6 is a cross-sectional view of a hydraulic system in a second position.

FIG. 6 is a cross-sectional view of an actuation system 98 in a second position. The actuation system 98 retracts the load pin 50 by pumping hydraulic fluid through a control line 184 and into the second chamber 178. The pressure of the hydraulic fluid then drives the plate 100 (e.g., piston 174) in axial direction 110 enabling spring 86 to retract the load pin 50 in radial direction 58. In order to maintain hydraulic pressure within the chamber 178, the hydraulic housing 170 may include one or more gaskets 186 (e.g., 1, 2, 3, 4, 5, or more gaskets or seals) that rest within one or more grooves 188 (e.g., 1, 2, 3, 4, 5, or more annular grooves) around the outlet 190. The gasket(s) 186 form a seal around the plate 100 as the plate 100 moves axially within the hydraulic housing 170.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a landing system, comprising:

a landing member configured to move between an extended position and a retracted position relative to a wall surrounding an axial bore of a mineral extraction system component;

a shaft configured to move within a radial bore in the wall surrounding the axial bore to drive the landing member in a first radial direction and a second radial direction;

an actuation system configured to move the shaft in the first radial direction through the radial bore to move the landing member into the extended position within the axial bore, wherein the landing member is configured to support a component within the axial bore after lowering the component through the axial bore toward the landing member; and a spring configured to drive the shaft in the second radial direction within the radial bore to retract the landing member.

2. The system of claim 1, wherein the landing member comprises a c-ring that rests within an annular groove on the mineral extraction system component.

3. The system of claim 1, wherein the shaft includes an annular groove that receives a seal, wherein the seal is configured to block the flow of fluid through the radial bore in the wall of the mineral extraction system component.

4. The system of claim 1, wherein the shaft comprises an annular lip that contacts the spring.

5. The system of claim 4, wherein the annular lip comprises a first retaining ring that couples to an annular groove on the shaft.

6. The system of claim 5, comprising an outer retaining ring with an aperture, wherein the outer retaining ring is configured to allow the shaft to move axially through the outer retaining ring while simultaneously blocking complete removal of the shaft from the radial bore in the wall of the mineral extraction system component.

7. The system of claim 1, wherein the actuation system comprises a plate with a first angled surface configured to contact a second angled surface on the shaft and to drive the shaft in the second radial direction within the radial bore in the wall of the mineral extraction system component.

8. The system of claim 7, wherein the actuation system comprises a mechanical actuation system.

9. The system of claim 7, wherein the actuation system comprises a hydraulic actuation system.

10. The system of claim 7, wherein the plate comprises an axial aperture configured to receive a bolt that couples the plate to the mineral extraction system component.

11. The system of claim 1, wherein the mineral extraction system component is a spool.

12. A system comprising, a mineral extraction system, comprising:

a spool comprising a wall surrounding an axial bore and a radial bore in the wall and fluidly coupled to the axial bore;

a landing system configured to support a component inside the axial bore, wherein the landing system comprises:

a landing member configured to move between an extended position and a retracted position relative to the wall surrounding the axial bore of the spool;

a shaft configured to move within the radial bore in the wall surrounding the axial bore to drive the landing member in a first radial direction and a second radial direction;

an actuation system configured to drive the shaft in the first radial direction through the radial bore to move the landing member into the extended position within the axial bore, wherein the landing member is configured to support the component within the axial bore after lowering the component through the axial bore toward the landing member; and a spring configured to drive the shaft in the second radial direction within the radial bore to retract the landing member.

13. The system of claim 12, wherein the component comprises a hanger.

14. The system of claim 12, wherein the landing member comprises a c-ring that rests within an annular groove on the spool.

15. The system of claim 12, wherein the shaft comprises an annular lip that contacts the spring.

16. The system of claim 15, wherein the annular lip comprises a first retaining ring that couples to an annular groove on the shaft.

17. The system of claim 16, comprising a second retaining ring with an aperture, wherein the second retaining ring is configured to allow the shaft to move axially through the second retaining ring while simultaneously blocking complete removal of the shaft from the radial bore in the spool.

18. A method, comprising:

driving an actuation system in an axial direction with respect to an axial bore of a mineral extraction system, wherein driving the actuation system comprises axially driving a plate;

driving a shaft in a first radial direction through a radial bore in a wall surrounding the axial bore of the mineral extraction system with the actuation system;

driving a landing member in the first radial direction into the axial bore with the shaft; and lowering a mineral extraction system component through the axial bore toward the landing member, wherein the landing member is configured to support the mineral extraction system component.

19. The method of claim 18, comprises retracting the landing member by driving the shaft in a second radial direction with a spring.

20. A method, comprising:

driving a shaft in a first radial direction through a radial bore in a wall surrounding an axial bore of a mineral extraction system with an actuation system;

driving a landing member in the first radial direction into the axial bore with the shaft;

lowering a mineral extraction system component through the axial bore toward the landing member, wherein the landing member is configured to support the mineral extraction system component; and retracting the landing member by driving the shaft in a second radial direction with a spring.

* * * * *